US011793304B2

(12) United States Patent
Benard et al.

(10) Patent No.: US 11,793,304 B2
(45) Date of Patent: Oct. 24, 2023

(54) TABLE WITH A CENTRAL EXTENSION

(71) Applicant: LAFUMA MOBILIER SAS, Anneyron (FR)

(72) Inventors: Jean-Charles Benard, Rians (FR); Jean-Baptiste Neltner, Saint Genis Laval (FR); Corrado Roani, Manthes (FR); Jean-Noël Pernet, Condamine la Doye (FR)

(73) Assignee: LAFUMA MOBILIER SAS, Anneyron (FR)

( * ) Notice: Subject to any disclaimer, the term of this patent is extended or adjusted under 35 U.S.C. 154(b) by 0 days.

(21) Appl. No.: 17/691,523

(22) Filed: Mar. 10, 2022

(65) Prior Publication Data

US 2022/0287450 A1 Sep. 15, 2022

(30) Foreign Application Priority Data

Mar. 12, 2021 (FR) ..... 21/02443

(51) Int. Cl.
*A47B 1/08* (2006.01)
*A47B 1/02* (2006.01)

(52) U.S. Cl.
CPC . *A47B 1/08* (2013.01); *A47B 1/02* (2013.01)

(58) Field of Classification Search
CPC ..... A47B 1/08; A47B 1/02
USPC ..... 108/83
See application file for complete search history.

(56) References Cited

U.S. PATENT DOCUMENTS 802,998 A * 10/1905 Lambert ..... A47B 1/08 108/83
1,503,195 A * 7/1924 Clifford ..... A47B 1/08 108/83
2,750,242 A * 6/1956 Viehmann ..... A47B 1/08 312/246
3,097,614 A * 7/1963 Duncan ..... A47B 1/10 108/83
3,515,077 A * 6/1970 Glowacki ..... A47B 1/08 108/89

(Continued)

FOREIGN PATENT DOCUMENTS

CN 201175090 Y 1/2009
CN 212066081 U 12/2020

(Continued)

*Primary Examiner* — Daniel J Troy
*Assistant Examiner* — Timothy M Ayres
(74) *Attorney, Agent, or Firm* — CANTOR COLBURN LLP

(57) ABSTRACT

A table with a central extension includes a chassis, two movable trays bearing on the chassis and adapted to be moved closer to each other to constitute on their own one continuous surface, or separated symmetrically from one another, or one independently of the other to allow the set-up of one or several central extension(s) between the movable trays. The chassis is made up of two spars of variable length, two cross-beams, the cross-beams and spars assembled perpendicularly in pairs to form a horizontal frame, and four legs extending at the four corners of the frame below the latter. Each spar includes two portions, a fixed spar and a movable spar, the the spars being made up of a profiled tube with a rectangular cross-section in which extends a slide with a rectangular cross-section and have a longitudinal central groove.

11 Claims, 4 Drawing Sheets

(56) References Cited

U.S. PATENT DOCUMENTS

| | | | | | |
|---|---|---|---|---|---|
| 3,769,919 | A * | 11/1973 | Thomas | A47B 1/08 | 108/83 |
| 3,912,210 | A | 10/1975 | Von Bohr | | |
| 3,927,918 | A * | 12/1975 | Dobbratz | A47B 1/10 | 384/23 |
| 3,980,026 | A * | 9/1976 | Thomas | A47B 1/08 | 248/188.1 |
| 4,297,952 | A * | 11/1981 | Zagaroli | A47B 1/02 | 108/65 |
| 10,441,069 | B2 * | 10/2019 | Andersson | A47B 1/08 | |
| 11,096,479 | B2 * | 8/2021 | Mansson | A47C 17/76 | |
| 2006/0032415 | A1 * | 2/2006 | Wang | A47B 1/08 | 108/83 |
| 2022/0142352 | A1 * | 5/2022 | Pernet | A47B 1/02 | |
| 2022/0304460 | A1 * | 9/2022 | Holma | A47B 1/02 | |
| 2022/0338615 | A1 * | 10/2022 | Andersson | A47B 1/02 | |

FOREIGN PATENT DOCUMENTS

| | | | | |
|---|---|---|---|---|
| FR | 1568723 | A | 5/1969 | |
| FR | 2261726 | A1 | 9/1975 | |
| KR | 20160010847 | A | 1/2016 | |
| WO | WO-2016184672 | A1 * | 11/2016 | A47B 13/003 |

* cited by examiner

TABLE WITH A CENTRAL EXTENSION

CROSS-REFERENCE TO RELATED APPLICATIONS

This application is related to and claims the benefit of French Patent Application No. 21/02443, filed on Mar. 12, 2021, the contents of which are hereby incorporated by reference in their entirety.

Technical Field

The present disclosure relates to the field of tables with central extension of the type comprising a chassis, two lateral trays, at least one of which is movably mounted relative to said chassis, and at least one central extension adapted to be positioned between the lateral trays, and more particularly a chassis of a table with central extension having high rigidity both in the closed position and in the extended position in which one or several so-called central extension(s) can be positioned between two movable trays secured to said chassis.

Background

In the field of furniture, and more particularly in that of tables, it is well known to make convertible tables whose length, and consequently the surface, can be increased or decreased at will by means of removable or stowable extensions.

The main known extension tables are the so-called Italian tables, with two extensions that can be stowed under the tray of the table or brought into the continuity of the two ends of this tray, and the tables with central extension, comprising above of a chassis two movable trays adapted to be moved closer to each other so as to constitute on their own one continuous surface or to be separated symmetrically from one another or one independently of the other, so as to allow the set-up of the central extension between them.

Such tables are in particular described in the documents FR2261726 and FR1568723.

The document FR2261726 describes an extension table, rectangular, square or at least having the two rectilinear, parallel and identical lateral sides, in which all the elements constituting it form an integral part of the frame of the table, characterized in that the two lateral sides of the frame of the table are at least of a height equal to the height of the one or two main shel(f/ves) plus the height of the extension shelf of the table, each of these two sides including at its internal face at least one rectilinear longitudinal guideway or notch as well as at least two vertical guideways or notches placed parallel to each other into an inverse-L shaped, the length of the vertical leg of this L being at least equal to the height of the one or two main shel(f/ves), the one or two main shel(f/ves) being provided laterally like the extension shelf of prominent elements such as pivots, teeth or ridges, that could allow moving said shelves in the guideways, the elements whose dimension depends on these said guideways, the length of the longitudinal guideways being enough only to allow such movement, of the or two main shel(f/ves), that the extension shelf is not only clear but also enough space is provided on either side of the extension shelf so as to be able to grasp it, lift it to bring it at least to the level of the or two main shel(f/ves), but also to move it slightly horizontally from the length of the horizontal leg of the inverted L.

The document FR1568723 describes a rectangular table, especially designed for the kitchen, whose legs and chassis are metallic and the worktop in Formica veneered wood. The worktop consists of a fixed portion and two extensions. These, in the closed position of the table, are housed under the fixed portion, and in the open position of the table, develop on either side of the fixed portion by means of carrier rails to come at the same level as the fixed portion.

All these extension tables are not suitable for outdoor use and they do not allow large dimension extension tables to be made including several extensions.

There are also known extension tables the dimensions of the frame of which are adaptable to receive one or several extension(s) of the tray. This is particularly the case of the U.S. Pat. No. 3,912,210.

The document U.S. Pat. No. 3,912,210 describes a chassis of a table or the same comprising two spars and two cross-beams disposed horizontally and extending perpendicularly in pairs to form a substantially rectangular frame, as well as four vertical legs extending at the four corners of said frame. The spars and the cross-beams consist of profiled tubes with a rectangular or square section in which extend tenons inserted and fastened in the opposite tubes of two portions of the contiguous structure.

This type of table has the drawback of not allowing a large expansion of the dimensions of the chassis. Furthermore, in the extended position, the chassis of the table does not have enough rigidity.

Summary

One of the aims of the disclosure is therefore to remedy these drawbacks by proposing a table with central extension having a simple and inexpensive design, the chassis of which includes expansion means allowing the set-up of one or several extension(s) while guaranteeing high rigidity of the chassis and, ultimately, of the table.

To this end, and in accordance with the disclosure, a table with central extension is proposed, comprising a chassis, two movable trays bearing on said chassis and adapted to be moved closer to each other so as to constitute on their own one continuous surface, or to be separated symmetrically from one another, or one independently of the other so as to allow the set-up of one or several so-called central extension(s) between said movable trays, said chassis consisting of two spars of variable length, two cross-beams, said cross-beams and the spars being assembled perpendicularly in pairs to form a horizontal frame, and four legs, for example four vertical legs, extending at the four corners of the frame under the latter; said table is remarkable in that each spar comprises two portions, a so-called fixed spar and a so-called movable spar, the fixed spar and the movable spar being made up of a profile with a rectangular cross-section in which extends a slide with a rectangular cross-section and comprising a longitudinal central groove, each of the free ends of the slide being provided with a slide tip, and the distal ends of the fixed and movables spars being respectively provided with a slide head and a complementary slide head adapted to cooperate by interlocking with the slide head.

Preferably, the longitudinal central groove of the slide has a rectangular or square cross-section and receives a square nut adapted to cooperate with a butterfly screw, the threaded rod of which extends through a hole made on the outer wall of the movable spar, the longitudinal slot leading into the longitudinal central groove having a width smaller than that of the longitudinal central groove and a width larger than the diameter of the threaded rod of the butterfly screw.

Furthermore, the slide includes a channel on either side of the longitudinal central groove.

Each slide tip consists of a parallelepiped part open at one of its ends to receive the free end of the slide and provided with square recesses adapted to receive the square nuts to allow the slide tip to be fastened to the free end of said slide by means of screws cooperating with said square nuts.

In addition, the slide head and the complementary slide head consist of a main body which is parallelepiped and open at both ends, to allow passage of the slide, and at one of their ends of a fixing plate extending perpendicularly to the longitudinal axis of the main body and provided at the upper end of the fixing plate with a lug and an aperture, the lug of the slide head being adapted to be inserted into the aperture of the complementary slide head and vice versa.

Preferably, the lug of the slide head and of the complementary slide head has a substantially triangular shape, the aperture of the slide head and of the complementary slide head having a vertical rectilinear slot shape.

Said aperture of the slide head and of the complementary slide head extends parallel to and along the triangular lug of the slide head and of the complementary slide head.

Furthermore, the table with central extension according to the disclosure comprises leg brackets connecting the cross-beams to the spars and adapted to receive the legs which are fastened to said leg brackets.

Each leg bracket includes a ring adapted to receive the upper end of a leg and two tenons extending on either side of the ring by forming a right angle, said tenons being adapted to be inserted into the profiles forming the spars and the cross-beams.

In addition, the table with central extension according to the disclosure includes reinforcing brackets positioned on the rear face of the leg brackets and tensioning brackets positioned on the rear face of the reinforcing brackets.

Preferably, the movable trays and the extension(s) are obtained in HPL compact laminate.

Incidentally, the table with central extension according to the disclosure includes a rack secured to the lower wall of one of the movable trays and adapted to receive at least one extension.

BRIEF DESCRIPTION OF THE DRAWINGS

Other advantages and features will become clearer from the following description of a single variant, provided as a non-limiting example, of the table with central extension in accordance with the disclosure, with reference to the appended drawings in which.

DETAILED DESCRIPTION OF THE DRAWINGS

Figure 1:
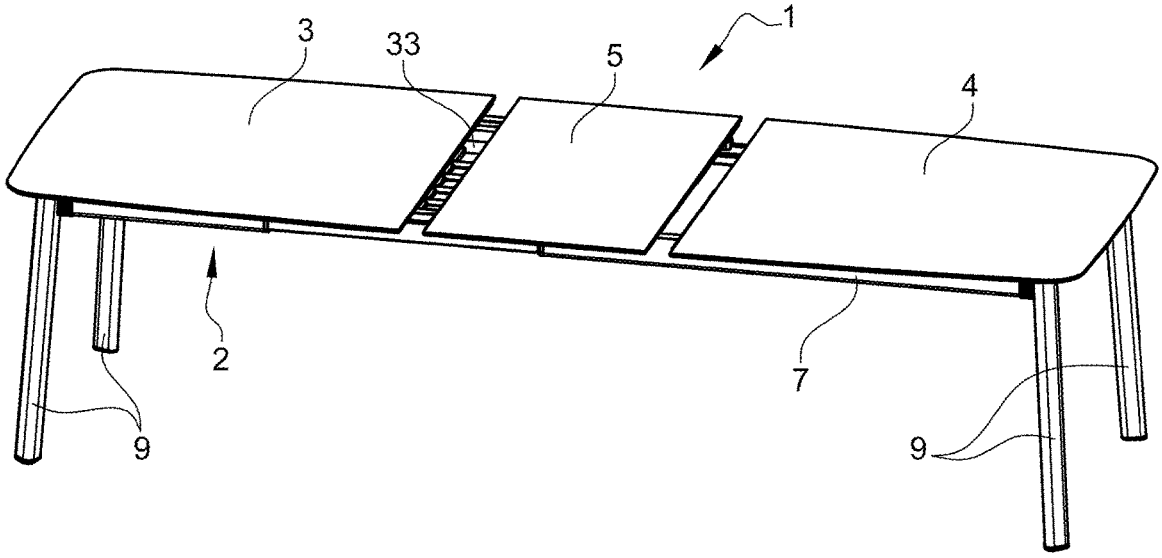
FIG. 1 is a perspective view of a table with central extension according to the disclosure, in the extended position with an extension.

In the rest of the description of the table with central extension according to the disclosure, the same reference numerals designate the same elements. The different views are not necessarily plotted to scale.

Figure 2:
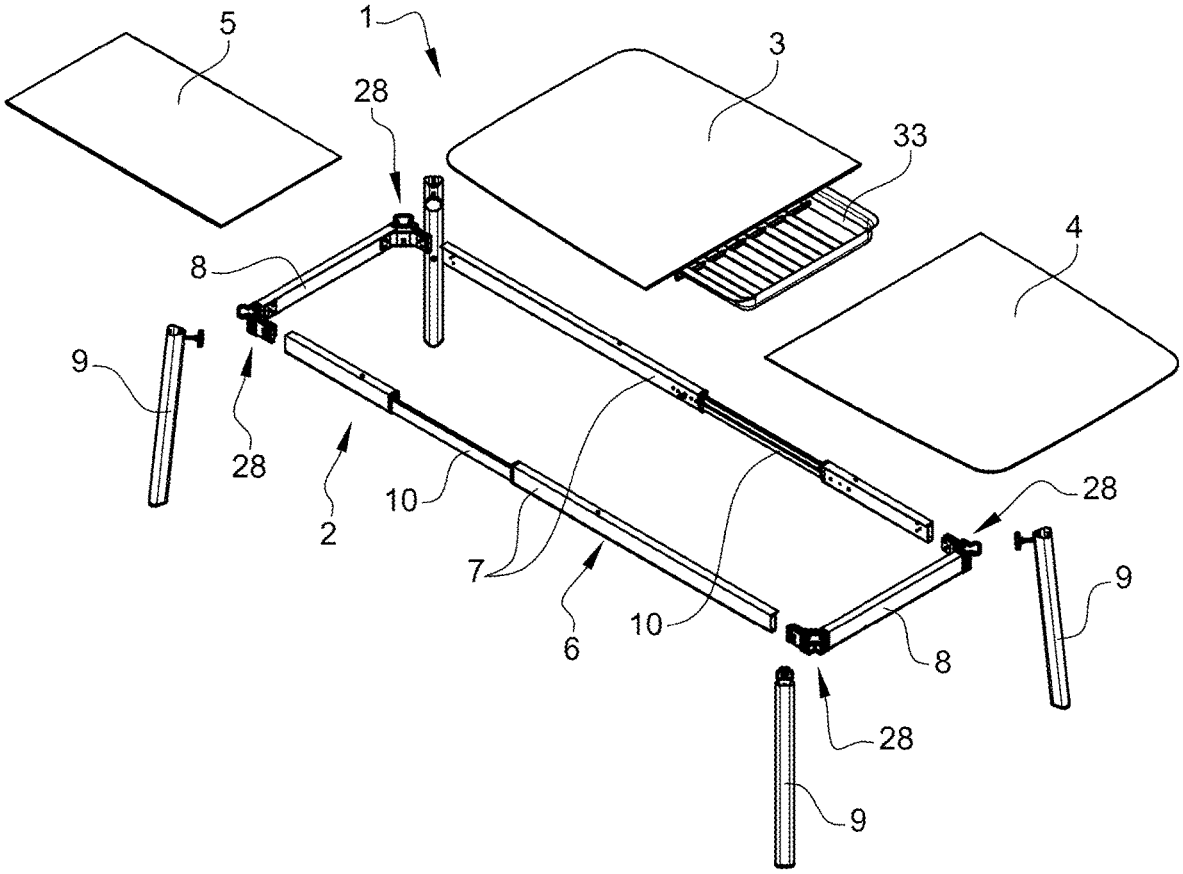
FIG. 2 is an exploded perspective view of the extension table according to the disclosure.
Figure 3:
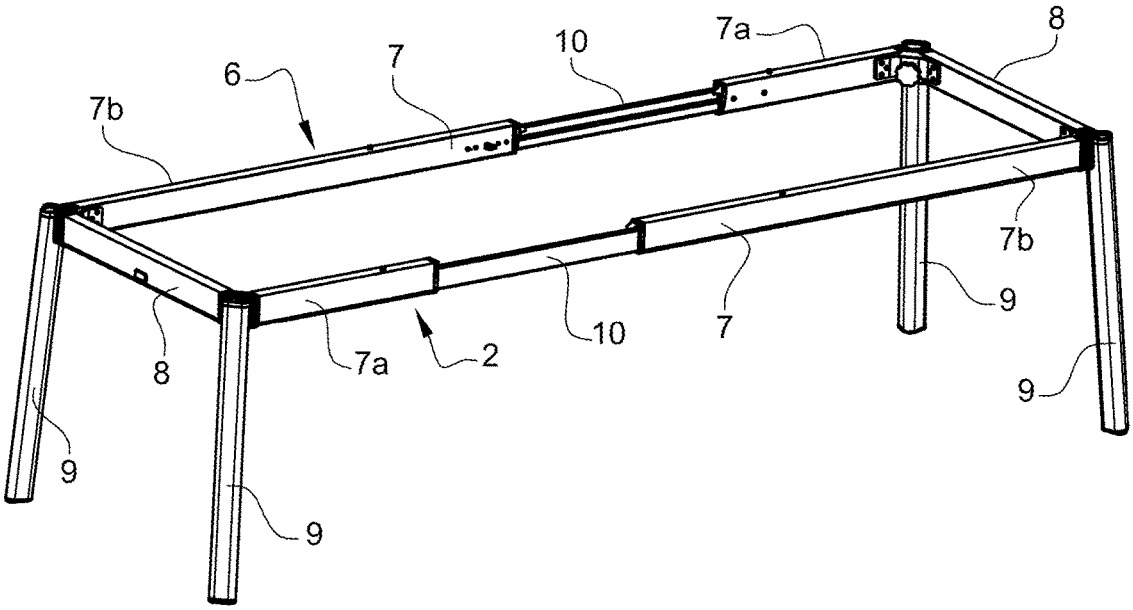
FIG. 3 is a perspective view of the chassis of the table with central extension according to the disclosure, in the extended position.
Figure 4:
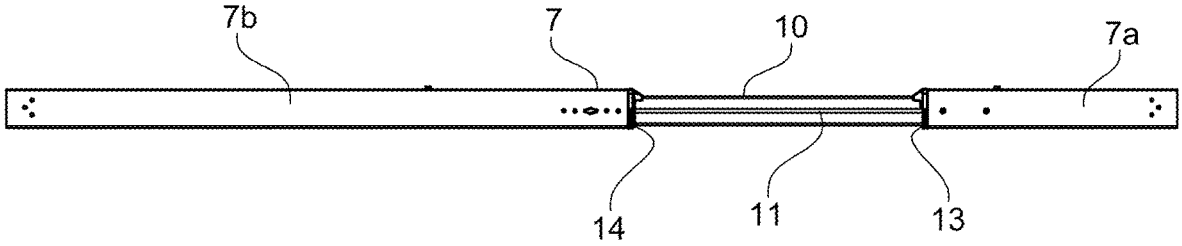
FIG. 4 is a side view of a spar of the chassis of the table with central extension according to the disclosure, in the extended position.
Figure 5:
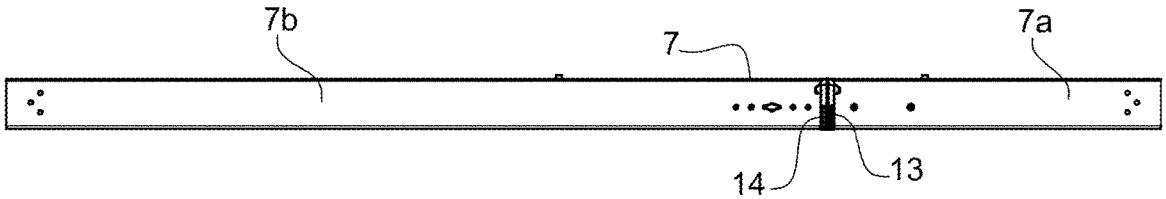
FIG. 5 is a side view of a spar of the chassis of the table with central extension according to the disclosure, in the so-called closed position.

Referring to FIGS. 1 to 3, the table with central extension 1 according to the disclosure comprises a chassis 2, two movable trays 3, 4 bearing on said chassis 2 and adapted to be moved closer to each other so to constitute on their own one continuous surface, or to be separated symmetrically from one another, or one independently of the other so as to allow the set-up of one or several so-called central extension(s) 5 between said movable trays 3, 4.

In this particular example, referring to FIGS. 1 to 3, the chassis 2 consists of a rectangular metal frame 6 consisting of two spars 7 and two cross-beams 8 and at the angles of which are secured legs 9, also metallic, said legs 9 being preferably inclined. The two spars 7 respectively comprise a slide 10 allowing increasing the dimensions of the frame 6, and conversely decreasing the dimensions of the frame 6, for the set-up and respectively the removal of a central extension 5 between the movable trays 3, 4 which are secured to the frame 6 on each side of the slides 10, as will be detailed below.

In this particular embodiment, the movable trays 3, 4 and the central extension 5 have a substantially rectangular shape; However, it is quite obvious that the movable trays 3, 4 and the central extension 5 may have any shape yet without departing from the scope of the disclosure.

Referring to FIGS. 2 to 10, each spar 7 comprises two portions, a so-called fixed spar 7*a* and a so-called movable spar 7*b* larger in length than the fixed spar 7*a*. In order to further improve the rigidity of the chassis 2, the movable spar 7*b* of a first spar 7 of the chassis 2 extends facing the fixed spar 7*a* of the second spar 7 of said chassis 2. The fixed spar 7*a* and the movable spar 7*b* consist of a profiled tube with a rectangular cross-section in which extends the slide 10 also with a rectangular cross-section and comprising a longitudinal central groove 11, each of the free ends of said slide 10 being provided with a slide tip 12, and the distal ends of the fixed 7*a* and movable 7*b* spars being respectively provided with a slide head 13 and a complementary slide head 14 adapted to cooperate by interlocking with the slide head 13 when the chassis 2 of the table is in the so-called closed position, i.e. when the movable trays 3 and 4 are contiguous.

Figure 6:
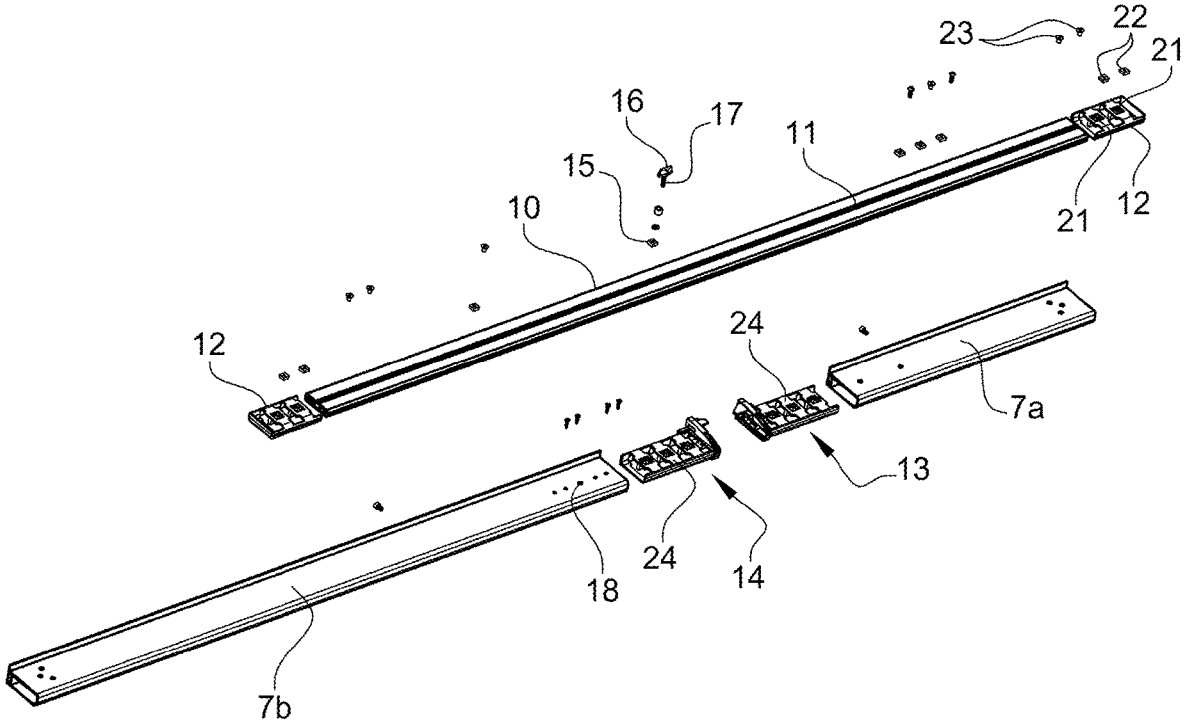
FIG. 6 is an exploded perspective view of a spar of the chassis of the table with central extension according to the disclosure.
Figure 7:
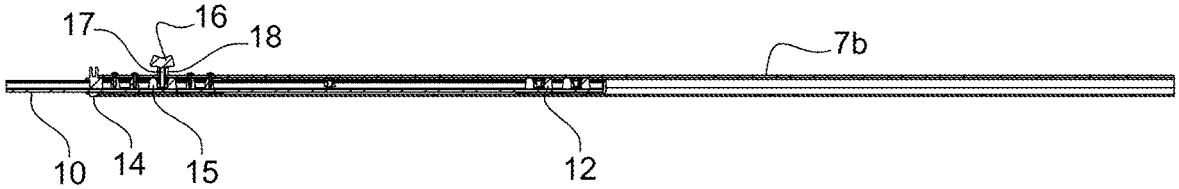
FIG. 7 is a longitudinal sectional view of a portion of a spar of the chassis of the table with central extension according to the disclosure.
Figure 10:
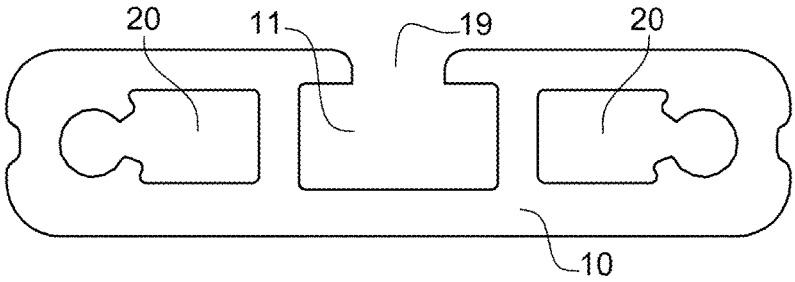
FIG. 10 is a cross-sectional view of the slide of a spar of the chassis of the table with central extension according to the disclosure.

Said longitudinal central groove 11 of the slide 10 has a rectangular or square cross-section and receives a square nut 15 adapted to cooperate with a butterfly screw 16 whose threaded rod 17 extends through a hole 18 made on the outer wall of the movable spar 7*b* (FIGS. 6 and 7). The slide 10 further includes a longitudinal slot 19 leading into the longitudinal central groove 11 and having a width smaller than that of the longitudinal central groove 11 and a width larger than the diameter of the threaded rod 17 of the butterfly screw 16 (FIG. 10). This butterfly screw 16 allows blocking the slide 10 in a determined position, i.e., in a closed position or in an extended position. In addition, referring to FIG. 10, the slide 10 includes on either side of the longitudinal central groove 11, a channel 20 for limiting the weight of the slide 10 while ensuring good rigidity.

Referring to FIG. 6, each slide tip 12 consists of a parallelepiped part open at one of its ends to receive the free end of the slide 10 and provided with square recesses 21 adapted to receive square nuts 22 to allow fastening of the slide tip 12 to the free end of said slide 10 by means of screws 23 cooperating with said square nuts 22.

Figure 8:
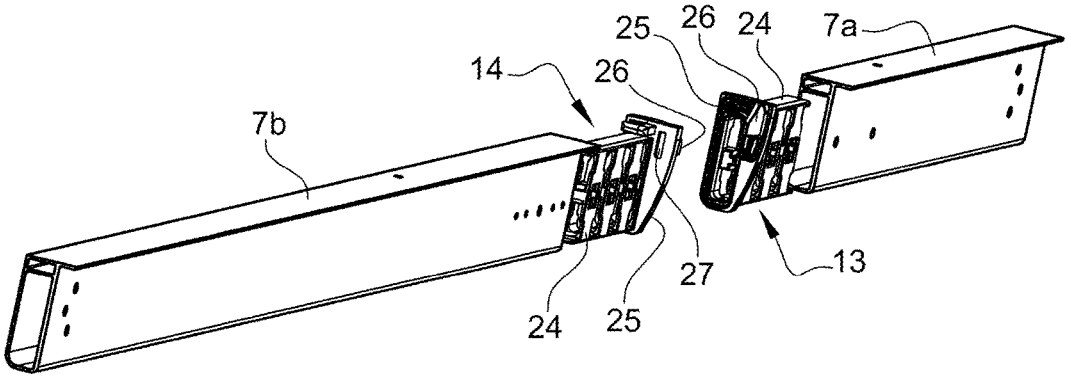
FIG. 8 is a perspective view of two portions of a spar and of the slide heads of the chassis of the table with central extension according to the disclosure.
Figure 9:
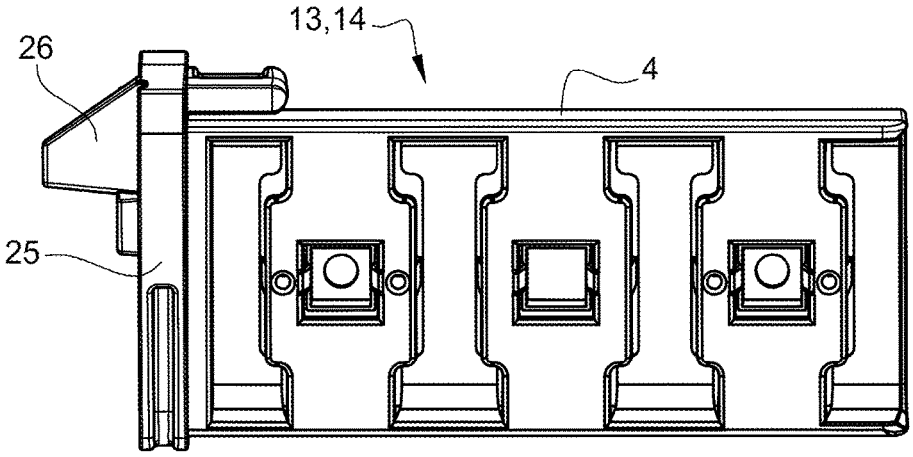
FIG. 9 is a side view of a slide head of a spar of the chassis of the table with central extension according to the disclosure.

In addition, referring to FIGS. 6, 8 and 9, each of the slide head 13 and the complementary slide head 14 consists of a main body 24 which is parallelepiped and open at both ends, to allow passage of the slide 10, and at one of their ends with a fixing plate 25 extending perpendicularly to the longitudinal axis of the main body 24 and provided, at the upper end of the fixing plate 25, with a lug 26 and an aperture 27, the lug 26 of the slide head 13 being adapted to be inserted into the aperture 27 of the complementary slide head 14 and vice versa. Said lug 26 of the slide head 13 and of the complementary slide head 14 has a substantially triangular shape, the aperture 27 of the slide head 13 and of the complementary slide head 14 having a vertical rectilinear slot shape. Said aperture 27 of the slide head 13 and of the complementary slide head 14 extends parallel to and along the triangular lug 26 of the slide head 13 and of the complementary slide head 14.

Figure 11:
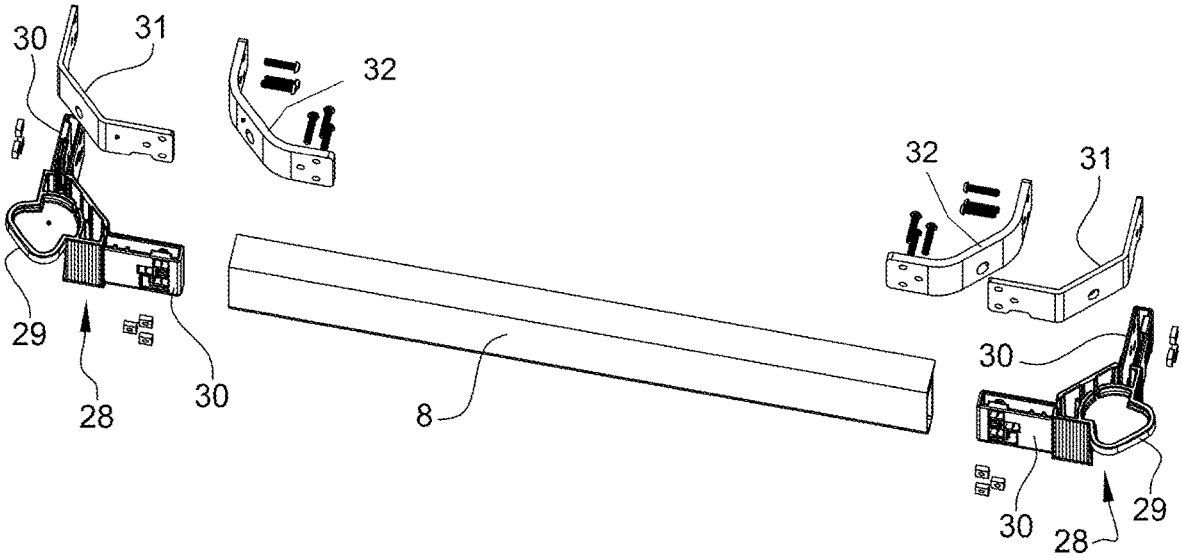
FIG. 11 is an exploded perspective view of a cross-beam and the brackets for fastening the legs of the chassis of the table with central extension according to the disclosure.

Furthermore, referring to FIGS. 2 and 11, the table with central extension according to the invention also comprises leg brackets 28 connecting the cross-beams 8 to the spars 7 and adapted to receive the legs 9 which are fastened to said leg brackets 28. Each leg bracket 28 includes a ring 29 adapted to receive the upper end of a leg 9 and two tenons 30 extending on either side of the ring 29 by forming a right angle, said tenons 30 being adapted to be inserted into the profiles forming the spars 7 and the cross-beams 8. In addition, the table with central extension according to the disclosure includes reinforcing brackets 31 positioned on the rear face of the leg brackets 28 and tensioning brackets 32 positioned on the rear face of the reinforcing brackets 31.

Incidentally, referring to FIGS. 1 and 2, the table with central extension according to the disclosure includes a rack 33 secured to the lower wall of one of the movable trays 3, 4 and adapted to receive at least one extension 5.

It will be noted that, preferably, the movable trays 3, 4 and the extension(s) 5 are obtained in HPL compact laminate.

Finally, it is quite obvious that the examples that have just been given are only but particular illustrations which are in no way limiting as to the fields of application of the disclosure.

The invention claimed is:

1. A table with a central extension comprising: a chassis, two movable trays bearing on said chassis and adapted to be moved closer to each other to constitute one continuous surface, or to be separated symmetrically from one another, or one independently of the other so as to allow the set-up of at least one of central extension disposed between said movable trays, said chassis being made up of two spars of variable length, two cross-beams, said cross-beams and the spars being assembled perpendicularly in pairs to form a horizontal frame, and four legs extending at the four corners of the horizontal frame and under the horizontal frame, wherein each spar comprises a fixed spar and a movable spar, each of the fixed spar and the movable spar being made up of a profiled tube with a rectangular cross-section in which extends a slide having a rectangular cross-section and comprising a longitudinal central groove, each of the free ends of the slide being provided with a slide tip, and the distal ends of the fixed and movable spars being respectively provided with a slide head and with a complementary slide head adapted to cooperate by interlocking with the slide head, wherein each of the slide head and the complementary slide head include a main body which is parallelepiped and open at both ends, to allow passage of the slide, and at one of their ends with a fixing plate extending perpendicularly to the longitudinal axis of the main body and provided at the upper end of the fixing plate with a lug and with an aperture, the lug of the slide head being adapted to be inserted into the aperture of the complementary slide head and vice versa.

2. The table with central extension according to claim 1, wherein the longitudinal central groove of the slide has a rectangular or a square cross-section and receives a square nut adapted to cooperate with a butterfly screw whose threaded rod extends through a hole made on the outer wall of the movable spar, a longitudinal slot leading into the longitudinal central groove having a width smaller than a longitudinal central groove width and a width larger than a diameter of the threaded rod of the butterfly screw.

3. The table with central extension according to claim 1, wherein the slide includes a channel on either side of the longitudinal central groove.

4. The table with central extension according to claim 1, wherein each slide tip includes a parallelepiped part open at one end of the slide tip to receive the free end of the slide and provided with square recesses adapted to receive square nuts to allow fastening of the slide tip at the free end of said slide by screws cooperating with said square nuts.

5. The table with central extension according to claim 1, wherein the lug of the slide head and of the complementary slide head has a substantially triangular shape, the aperture of the slide head and of the complementary slide head having a vertical rectilinear slot shape.

6. The table with central extension according to claim 5, wherein the aperture of the slide head and of the complementary slide head extends parallel and along the triangular lug of the slide head and of the complementary slide head.

7. The table with central extension according to claim 1, further comprises leg brackets connecting the cross-beams to the spars and adapted to receive the legs which are fastened to said leg brackets.

8. The table with central extension according to claim 7, wherein each leg bracket includes a ring adapted to receive the upper end of a leg and two tenons extending from either side of the ring by forming a right angle, said tenons being adapted to be inserted into the profiles forming the spars and the cross-beams.

9. The table with central extension according to claim 8, further comprises reinforcing brackets positioned on the rear face of the leg brackets and tensioning brackets positioned on the rear face of the reinforcing brackets.

10. The table with central extension according to claim 1, wherein the movable trays and the extension(s) are obtained from HPL compact laminate.

11. The table with central extension according to claim 1, further comprising a rack secured to the lower wall of one of the movable trays and adapted to receive at least one extension.

* * * * *